US011277895B1

(12) United States Patent
Salam et al.

(10) Patent No.: US 11,277,895 B1
(45) Date of Patent: Mar. 15, 2022

(54) LED DRIVER CONTROL USING MCU

(71) Applicant: Silicon Laboratories Inc., Austin, TX (US)

(72) Inventors: Younas Abdul Salam, Austin, TX (US); Clayton Daigle, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 17/212,494

(22) Filed: Mar. 25, 2021

(51) Int. Cl.
*H05B 45/34* (2020.01)
*H05B 45/345* (2020.01)
*H05B 45/37* (2020.01)

(52) U.S. Cl.
CPC ..... *H05B 45/345* (2020.01); *H05B 45/37* (2020.01)

(58) Field of Classification Search
CPC ..... H05B 45/00; H05B 45/34; H05B 45/345; H05B 45/37; H05B 47/00
See application file for complete search history.

(56) References Cited

U.S. PATENT DOCUMENTS

2013/0020955 A1* 1/2013 Igaki ..... H05B 45/10 315/201
2017/0181242 A1* 6/2017 Johnson ..... H05B 45/10

* cited by examiner

*Primary Examiner* — Jimmy T Vu
(74) *Attorney, Agent, or Firm* — Nields, Lemack & Frame, LLC

(57) ABSTRACT

A system and method for controlling the current to an LED array is disclosed. The system comprises a microcontroller and an external transistor. The microcontroller has access to the relevant voltages in the circuit, including the voltage across the sense resistor, the voltage at the drain of the external transistor and the high voltage input. By monitoring these voltages, the microcontroller may be able to control the gate input to the external transistor so as to control the current in the LED array. Further, the microcontroller includes provisions to allow for dimming of the LED array, if desired. This configuration allows for post-manufacturing changes to the operation of the system without any hardware modifications.

18 Claims, 6 Drawing Sheets

LED DRIVER CONTROL USING MCU

This disclosure describes systems and methods for controlling an LED array using a microcontroller without the use of a separate LED driver integrated circuit.

BACKGROUND

LED (Light Emitting Diode) light bulbs typically use an external driver integrated circuit (IC) to regulate and control the current passing through the LED array.

FIG. 1 shows a generic block diagram of a LED array control circuit. Typically, the LED array control circuit comprises a high voltage AC rectifier and filter block 1, which provides the high voltage (HV) signal for the circuit. The input to this high voltage AC rectifier and filter block 1 is typically a line voltage, such as 120 or 240 VAC. The high voltage AC rectifier and filter block 1 rectifies this input voltage and creates the HV signal. The HV signal is typically a DC signal and is used as an input to a LED Driver block 2. The LED Driver block 2 typically includes a FET to control the passage of current from the LED array to ground. The LED Driver block 2 also includes circuitry to control the enabling and disabling of the FET. The HV signal is also used to power the LED Array block. The LED Array block 3 comprises the LED array and typically also includes a mechanism to measure the current passing with the LED array. For example, a sense resistor, either high side or low side, may be used to measure the current through the LED array. An inductor may also be disposed in the LED Array block 3. A microcontroller unit (MCU) 4 is in communication with the LED Driver block 2 and may be used to adjust the amount of dimming of the LED Array. This block diagram may be implemented in a variety of ways.

For example, FIG. 2 shows one such circuit, which includes an external LED driver IC 50 and the associated circuitry. In this example, a full wave rectifier 10 is used to create a DC voltage, which is referred to as the HV signal. This DC voltage is supplied to the anode of a first LED in the LED array 20. The LEDs in the LED array 20 are typically arranged in series. An inductor 30 is used to maintain a more constant current through the LEDs in the LED array 20. One terminal of the inductor 30 is connected to the LED array 20, such as the cathode of the last LED in the LED array 20, while the second terminal is connected to the LED IC 50. Within the LED driver IC 50, there is a transistor, typically a field effect transistor (FET), wherein the output from the inductor is connected to the drain of the FET. The source of the FET may be connected to a sense resistor 60, which is disposed outside of the LED driver IC 50.

The anode of a diode 70 is connected to the output of the inductor 30. The cathode of the diode 70 is connected to the HV signal. The diode is used to conduct current through the LED array 20 when the FET is disabled.

Additionally, in some embodiments, the LED driver IC 50 includes a PWM input, which allows a separate microcontroller 40 to supply an input that may be used to achieve the desired level of dimming.

In operation, the LED driver IC 50 enables the FET so that current flows through the LED array 20, the inductor 30, the FET and the sense resistor 60. This may be referred to as active mode. The LED driver IC monitors the voltage at the sense resistor 60 and when it reaches a predetermined value (which is not selectable), it turns off the FET. At this point, the inductor 30 continues to supply current, which is directed through diode 70 and back into the LED array 20. This may be referred to as loop mode.

In certain embodiments, the FET typically has a predetermined off time, which may be determined based on a one-shot circuit located inside the LED driver IC 50. In other words, once the FET is turned off because the sense resistor 60 reached the predetermined voltage, the FET remains off for a predetermined period of time before being enabled again. In some embodiments, the FET may have predetermined minimum and maximum off times and on times.

The PWM input is used to further control the amount of current that flows through the FET. When low, the PWM input causes the FET to turn off. When high, the PWM input allows normal operation of the LED driver IC 50.

In other embodiments, the sense resistor may be disposed on the high side of the FET so as to measure the current through the LED array 20 even when the FET is disabled.

FIG. 2 shows one specific embodiment of the LED array control circuit. Of course, this circuit may be implemented in other ways. In all of these embodiments, the LED driver IC 50 is separate from the microcontroller 40, and the only communication between the microcontroller 40 and the LED driver IC 50 is a signal from the microcontroller 40 to the LED driver IC 50 related to the amount of dimming.

This approach has several shortcomings. First, the microcontroller 40 has no visibility into the operation of the LED array 20. In other words, the microcontroller 40 only provides a single output to the LED driver IC 50 and receives no inputs. Therefore, the microcontroller 40 cannot determine when a failure has occurred.

Further, the microcontroller 40 can only perform limited calibration through the PWM input, and relies on the frequency and DC voltage available to the LED driver IC 50.

Finally, this approach requires multiple components; a microcontroller 40 to provide the dimming control, and a separate LED driver IC 50 to control the current through the LED array 20. This may require more real estate and increase cost.

Therefore, it would be beneficial if there was a system and method that reduced the complexity of the circuit, while simultaneously providing more flexibility. It would also be advantageous if changes to this circuit could be made using firmware updates, rather than hardware changes.

SUMMARY

A system and method for controlling the current to an LED array is disclosed. The system comprises a microcontroller and an external transistor. The microcontroller has access to the relevant voltages in the circuit, including the voltage across the sense resistor, the voltage at the drain of the external transistor and the high voltage input. By monitoring these voltages, the microcontroller may be able to control the gate input to the external transistor so as to control the current in the LED array. Further, the microcontroller includes provisions to allow for dimming of the LED array, if desired. In certain embodiments, this configuration allows for post-manufacturing changes to the operation of the system without any hardware modifications.

According to one embodiment, a circuit for driving an LED array is disclosed. The circuit comprises the LED array in communication with a high voltage (HV) signal; an inductor in series with the LED array; a sense resistor connected to ground; an external transistor comprising a drain, a source and a gate, wherein the drain is in communication with the inductor and the source is in communication with the sense resistor, such that when the external transistor is enabled, current flows from the HV signal through the LED array, the inductor, the external transistor and the sense resistor; a diode disposed between the drain and the HV signal; and a microcontroller, comprising: an output signal, referred to as the DRIVE signal, that controls the gate of the external transistor; a first analog input in communication with the source of the external transistor, referred to as the SENSE signal; and a second analog input in communication with a signal representative of a voltage at the drain of the external transistor, referred to as the SCALED DRAIN signal; wherein, during a first initialization procedure, the microcontroller determines an amount of time, after the external transistor is enabled, for the SENSE signal to reach a predetermined voltage, referred to as an ON TIME value, and wherein during normal operation, the microcontroller uses the ON TIME value to control the DRIVE signal. In certain embodiments, the microcontroller comprises a timer and an analog comparator, wherein the analog comparator compares the SENSE signal to the predetermined voltage, and generates an output when the SENSE signal is greater than the predetermined voltage, and wherein a value of the timer is saved as the ON TIME value when the output of the analog comparator is asserted. In some embodiments, a value indicative of the predetermined voltage is stored in a writable register and is related to a level of dimming desired. In certain embodiments, during a second initialization procedure, the microcontroller determines an amount of time, after the external transistor is disabled, for the SCALED DRAIN signal to drop to a second predetermined voltage, referred to as an OFF TIME value, and wherein during normal operation, the microcontroller uses the OFF TIME value to control the DRIVE signal. In some embodiments, a value indicative of the second predetermined voltage is stored in a writable register and is related to a level of dimming desired. In certain embodiments, the microcontroller comprises a timer and a second analog comparator, wherein the analog comparator compares the SCALED DRAIN signal to the second predetermined voltage, and generates an output when the SCALED DRAIN signal is less than the second predetermined voltage, and wherein a value of the timer is saved as the OFF TIME value when the output of the second analog comparator is asserted. In some embodiments, the microcontroller adds the ON TIME value and the OFF TIME value to calculate a period of the DRIVE signal. In some embodiments, a timer internal to the microcontroller is used to control the DRIVE signal based on the ON TIME value and the OFF TIME value. In some embodiments, the circuit comprises a scaling circuit in communication with the drain of the external transistor to generate a scaled version of the voltage at the drain, referred to as the SCALED DRAIN signal. In some embodiments, the microcontroller comprises a third analog input representative of the HV signal, referred to as the SCALED HV signal. In certain embodiments, the circuit comprises a second scaling circuit in communication with the HV signal to generate the SCALED HV signal. In some embodiments, the microcontroller monitors the SCALED HV signal before performing the first initialization procedure. In certain embodiments, the controller waits for the SCALED HV signal to reach a maximum value before performing the first initialization procedure. In some embodiments, the DRIVE signal is directly connected to the gate of the external transistor.

According to another embodiments, a circuit for driving an LED array is disclosed. The circuit comprises the LED array in communication with a high voltage (HV) signal; an inductor in series with the LED array; a sense resistor connected to ground; an external transistor comprising a drain, a source and a gate, wherein the drain is in communication with the inductor and the source is in communication with the sense resistor, such that when the external transistor is enabled, current flows from the HV signal through the LED array, the inductor, the external transistor and the sense resistor; a diode disposed between the drain and the HV signal; and a microcontroller, comprising: an output signal, referred to as the DRIVE signal, that controls the gate of the external transistor; and a first analog input in communication with the source of the external transistor, referred to as the SENSE signal; wherein, after performing a first initialization procedure, the microcontroller controls the DRIVE signal without monitoring the SENSE signal. In some embodiments, the microcontroller comprises a second analog input in communication with a signal representative of a voltage at the drain of the external transistor, referred to as the SCALED DRAIN signal; and, during a second initialization procedure, the microcontroller determines an amount of time, after the external transistor is disabled, for the SCALED DRAIN signal to drop to a second predetermined voltage, referred to as an OFF TIME value, and wherein during normal operation, the microcontroller uses the OFF TIME value to control the DRIVE signal without monitoring the SCALED DRAIN signal.

According to another embodiment, a microcontroller for controlling an LED array is disclosed. The microcontroller comprises an output signal, referred to as the DRIVE signal, configured to control a gate of an external transistor; a first analog input in communication with a source of the external transistor, referred to as the SENSE signal; and a second analog input in communication with a signal representative of a voltage at a drain of the external transistor, referred to as the SCALED DRAIN signal; a timer; a writable register; and an analog comparator; wherein, during a first initialization procedure, the analog comparator compares the SENSE signal to a predetermined voltage, wherein a value indicative of the predetermined voltage is stored in the writable register; and wherein an amount of time, referred to as an ON TIME value, after the DRIVE signal is asserted for the SENSE signal to reach the predetermined voltage is saved as the ON TIME value when the output of the analog comparator is asserted; and wherein during normal operation, the microcontroller uses the ON TIME value to control the DRIVE signal. In certain embodiments, the microcontroller comprises a second analog comparator and a second writable register, wherein the second analog comparator compares the SCALED DRAIN signal to the second predetermined voltage, wherein a value indicative of the second predetermined voltage is stored in the second writable register; and wherein an amount of time, referred to as an OFF TIME value, after the DRIVE signal is deasserted, for the SCALED DRAIN signal to drop to the second predetermined voltage is saved as the OFF TIME value when the output of the second analog comparator is asserted; and wherein during normal operation, the microcontroller uses the ON TIME value and the OFF TIME value to control the DRIVE signal. In certain embodiments, the microcontroller comprises a second analog comparator and a second writable register, wherein the second analog comparator compares the SCALED DRAIN signal to the second predetermined voltage, wherein a value indicative of the second predetermined voltage is stored in the second writable register; and wherein a total amount of time, after the DRIVE signal was asserted until the SCALED DRAIN signal drops to the second predetermined voltage is saved as a period, when the output of the second analog comparator is asserted and wherein during normal operation, the microcontroller uses the ON TIME value and the period to control the DRIVE signal.

BRIEF DESCRIPTION OF THE DRAWINGS

For a better understanding of the present disclosure, reference is made to the accompanying drawings, in which like elements are referenced with like numerals, and in which.

DETAILED DESCRIPTION

As described above, the use of a separate LED driver IC 50 has many limitations. Thus, a system and method of incorporating the current control of the LED array 20 into the microcontroller would be very beneficial.

Figure 1:
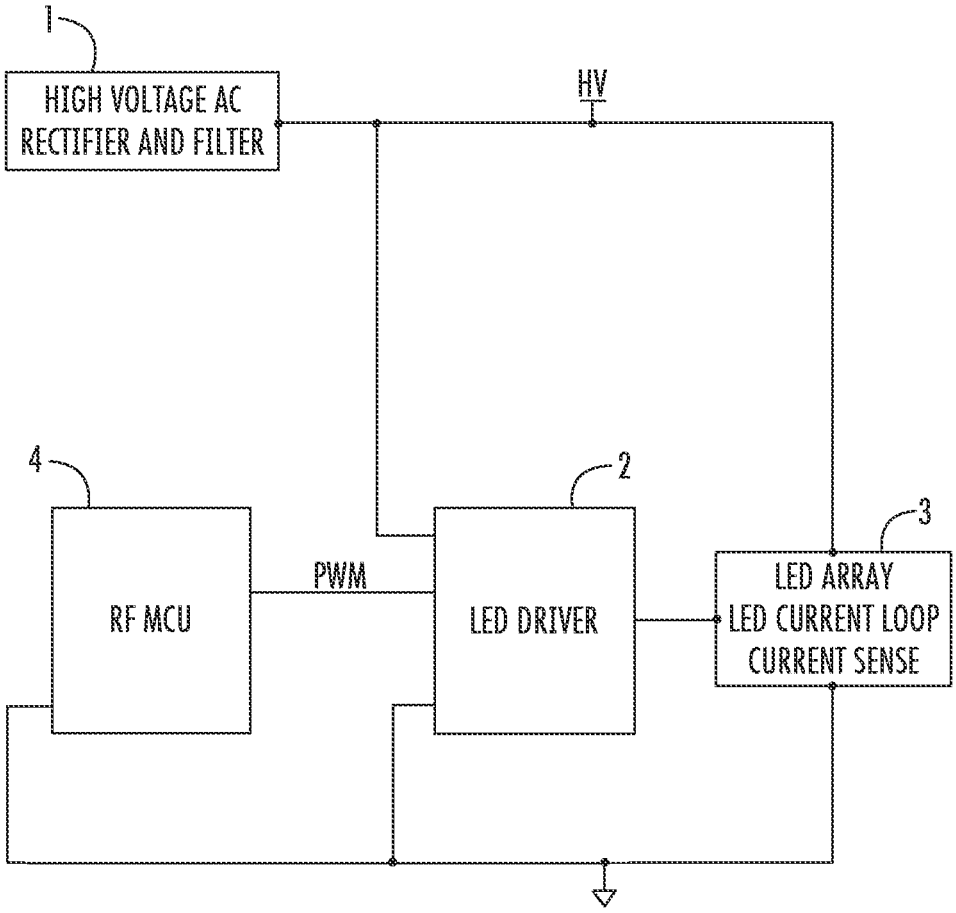
FIG. 1 PRIOR ART
FIG. 1 is a block diagram showing the LED array control circuit according to the prior art.
Figure 2:
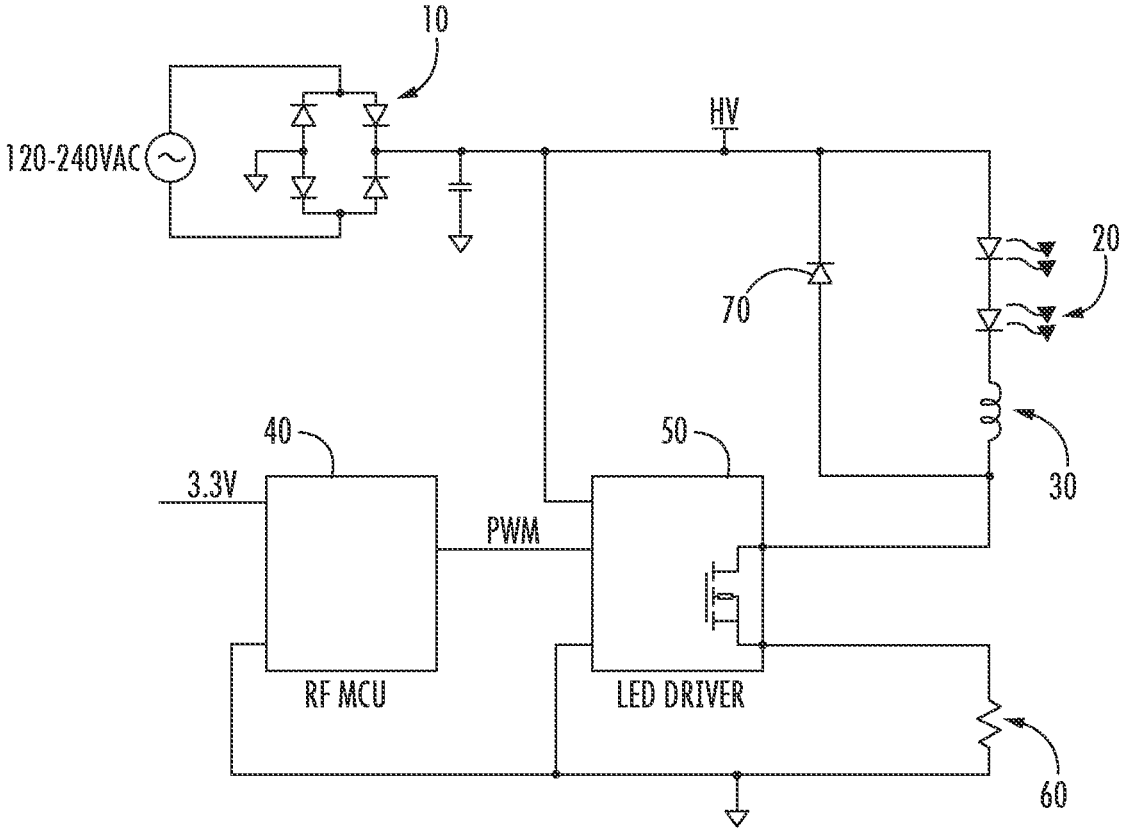
FIG. 2 PRIOR ART
FIG. 2 is one embodiment of a circuit for controlling an LED array according to the prior art.
Figure 3:
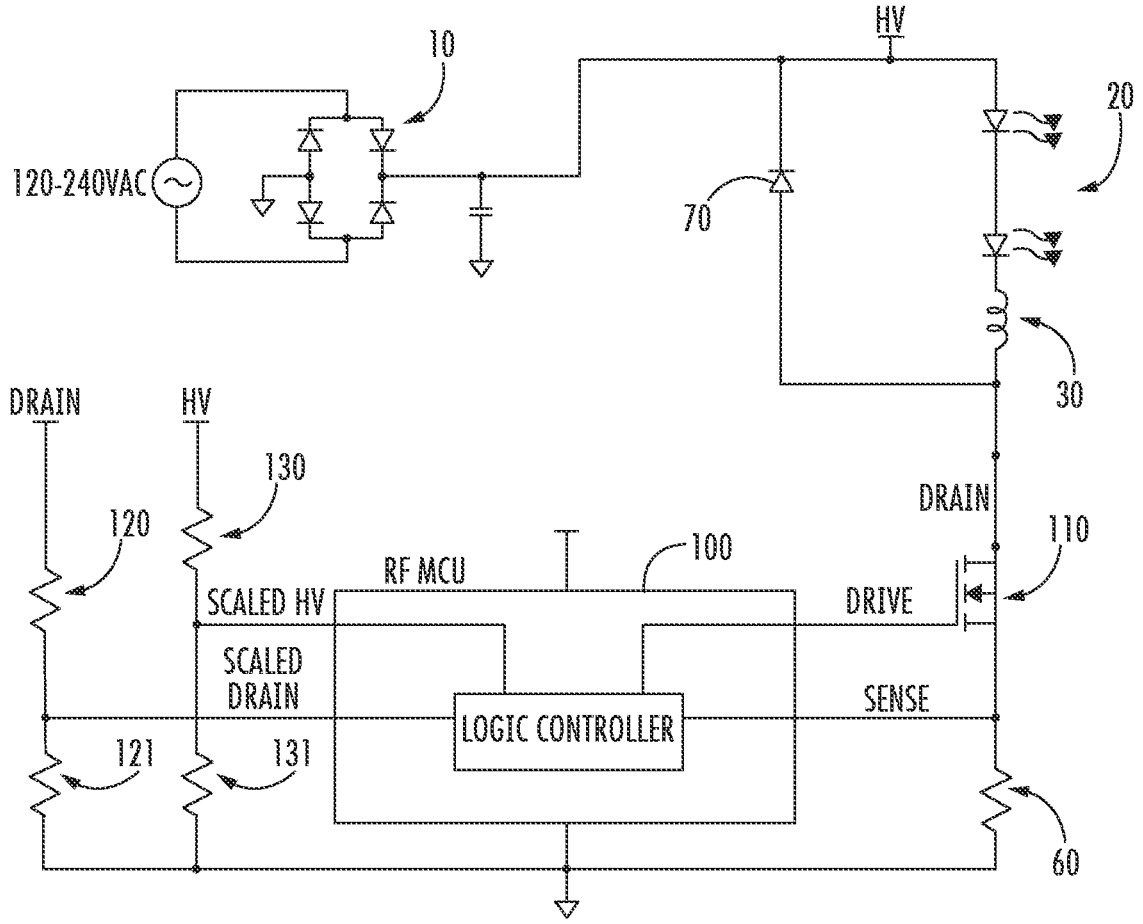
FIG. 3 is a circuit for controlling an LED array according to one embodiment.

FIG. 3 shows a block diagram according to one embodiment. Components with the same function as those shown in FIG. 2 have been given identical reference designators.

In this embodiment, an external transistor 110 is utilized. This external transistor may be a field effect transistor (FET). The drain of the external FET 110 is in communication with the second terminal of the inductor 30. For example, the drain may be electrically connected to the second terminal of the inductor. The source of the external FET 110 is in communication with the sense resistor 60. In some embodiments, the source is electrically connected to the sense resistor 60.

A microcontroller 100 is used to control the current through the LED array 20. To do so, the microcontroller 100 controls the gate of the external FET 110, such as through the use of a DRIVE signal. The microcontroller 100 also has an analog input which is the voltage across the sense resistor 60, labelled SENSE.

The microcontroller 100 may also have an analog input related to the voltage at the drain of the external FET 110. In some embodiments, this voltage may be much greater than the supply voltage for the microcontroller 100. Thus, in certain embodiments, a first scaling circuit, such as a voltage divider comprising resistor 120 and resistor 121, may be used to scale the drain voltage to a voltage that is less than the supply voltage of the microcontroller 100. In other embodiments, the drain voltage may be scaled using any other circuit, such as a transformer or opamp circuit. The output from this first scaling circuit may be referred to as SCALED DRAIN. In other embodiments, the first scaling circuit may not be required, such that the drain voltage is directly connected to the microcontroller 100. In both embodiments, the microcontroller 100 receives an analog input that is representative of the voltage at the drain of the external FET 110.

Similarly, the microcontroller 100 may also have an additional analog input related to the voltage of the HV signal. In some embodiments, a second scaling circuit, such as a second voltage divider comprising resistor 130 and resistor 131, may be used to scale the high voltage (HV) signal to a voltage that is less than the supply voltage of the microcontroller 100. In other embodiments, the high voltage (HV) signal may be scaled using any other circuit, such as a transformer or opamp circuit. The output from this second scaling circuit may be referred to as SCALED HV. In other embodiments, the second scaling circuit may not be required, such that the high voltage (HV) signal is directly connected to the microcontroller 100. In both embodiments, the microcontroller 100 receives an analog input that is representative of the HV signal.

Thus, in certain embodiments, the microcontroller 100 may have three analog inputs (SENSE, SCALED DRAIN, SCALED HV) and supply one digital output (i.e., the DRIVE signal). In other embodiments, the three analog inputs may include the SENSE signal, an analog signal representative of the drain voltage and an analog signal representative of the HV signal. In yet other embodiments, the three analog inputs may include the SENSE signal, the drain voltage and the HV signal. Using these signals, the microcontroller 100 is able to control the external FET 110 and thereby control the current to the LED array 20.

Figure 4:
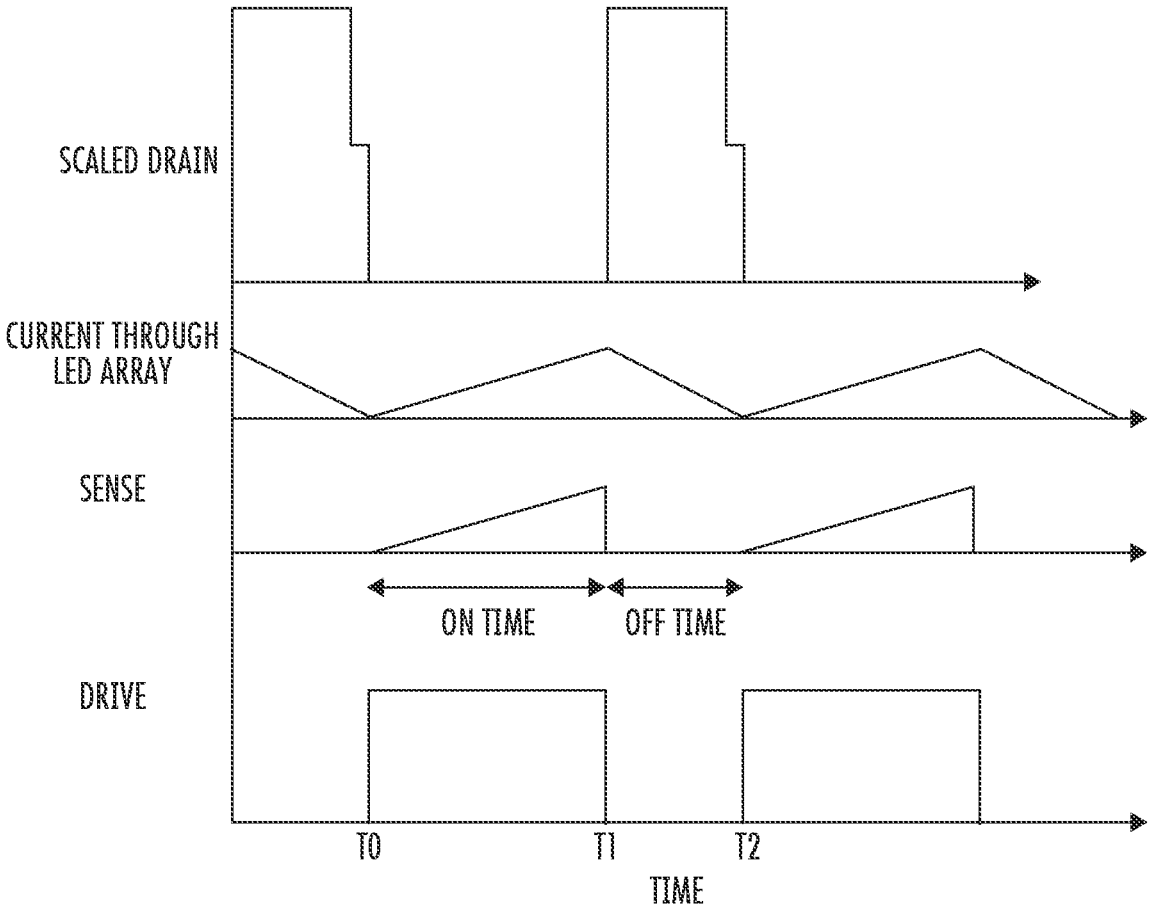
FIG. 4 shows a timing diagram illustrating the SCALED DRAIN signal, the current through the LED array, the SENSE signal and the DRIVE signal according to one embodiment.

FIG. 4 shows a timing diagram showing the SCALED DRAIN signal, the current through the LED array 20, the SENSE signal and the DRIVE signal according to one embodiment. Note that the drain voltage follows the same pattern as the SCALED DRAIN signal, only with a different amplitude. At time T0, the DRIVE signal is asserted. This causes the SCALED DRAIN signal to drop to a voltage near zero, due to its connection to ground through the external FET 110 and the sense resistor 60. Current then begins flowing through the external FET 110 and the sense resistor 60. Due to the inductance and capacitance of the current path, the flow of current increases gradually, as shown in the SENSE signal and the current through the LED array 20. Thus, the SENSE signal may ramp slowly from zero volts to a higher voltage. At the same time, the current through the LED array 20 also ramps upward.

At time T1, the DRIVE signal is deasserted, stopping the flow of current through the sense resistor 60, causing the SENSE signal to go to zero volts. The system then enters loop mode, where the inductor 30 provides the current to continue activating the LED array 20. Ideally, the current that is provided by the inductor 30 is roughly the same as the current that was passing through the sense resistor 60 immediately before the external FET 110 was turned off.

To supply this current, the voltage across the inductor 30 changes nearly instantaneously, as shown in the SCALED DRAIN signal. As current flows from the inductor 30 through diode 70 and through the LED array 20, this drains the energy stored in the inductor 30. Over time, the current through the LED array 20 decreases as the energy within the inductor 30 is depleted. Once the energy is depleted, the SCALED DRAIN signal drops.

At time T2, the cycle repeats with the DRIVE signal being asserted again.

Thus, based on these signals, the microcontroller 100 can control the LED array 20. Furthermore, the microcontroller 100 may utilize these signals to also control the dimming of the LED array 20.

As described above, traditional LED driver ICs use the voltage across the sense resistor 60 and a fixed off time to control the LED array 20. In certain embodiments, traditional LED Driver ICs may have some visibility on how much off time is required. The present microcontroller 100 may more accurately and precisely control the LED array 20.

As seen in FIG. 4, there are two key parameters; the duration of time that the DRIVE signal is asserted (ON TIME) and the duration of time that the DRIVE signal is deasserted (OFF TIME). These two parameters can be used to control the current through the LED array 20 and also control its brightness.

These parameters can be determined in a number of ways.

Figure 5:
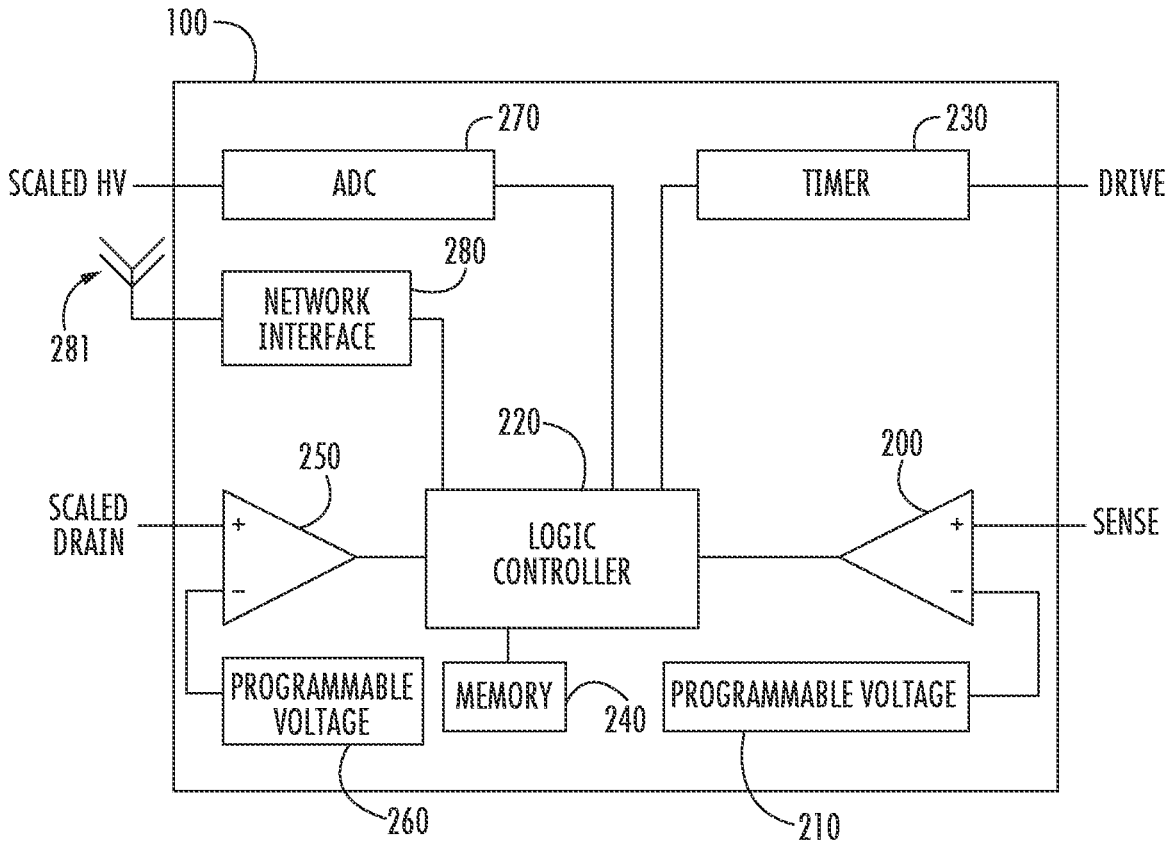
FIG. 5 shows the internal architecture of the microcontroller according to one embodiment.

In one embodiment, shown in FIG. 5, the microcontroller 100 includes an analog comparator 200 to compare the SENSE signal to a programmable voltage 210. This programmable voltage 210 may be stored in a writable register, so that it can be modified if desired. The output of the writable register may be in communication with a Digital to Analog converter (DAC), which converts the value in the writable register to an analog voltage. In other embodiments, the register value may be used to divide the incoming voltage. In certain embodiments, this programmable voltage 210 may be determined based on the amount of dimming that is desired. For example, a first value may be used when no dimming is desired, while a second value, less than the first value, may be used when some level of dimming is desired. In certain embodiments, the output from the analog comparator 200 may be used as an interrupt signal to the logic controller 220. In other embodiments, the output from the analog comparator 200 may be used to directly modify a variable value.

The logic controller 220 may be an embedded processing unit, which executes instructions. These instructions may be stored in memory 240. In certain embodiments, these instructions may be updated via firmware update. The logic controller 220 may also include other functions, such as interrupts, direct memory access (DMA) engines, and other functions. The instructions allow the logic controller 220 to perform the functions described herein.

Figure 6A:
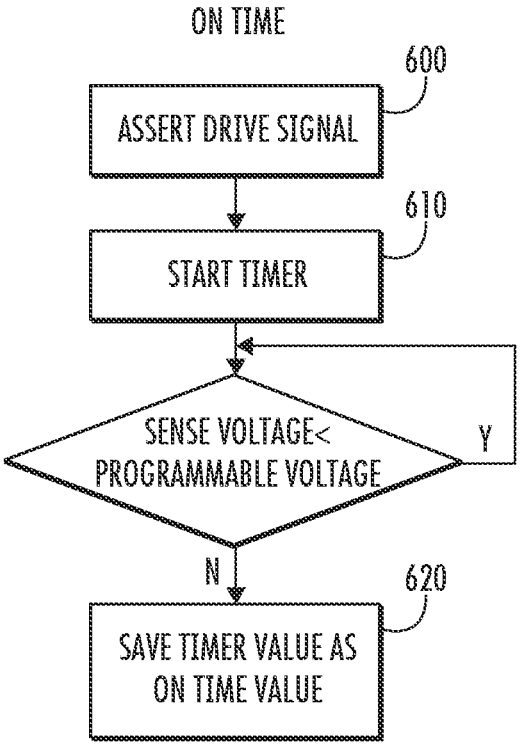
FIGS. 6A-6B show the initialization procedures that may be performed by the microcontroller according to one embodiment.
Figure 6B:
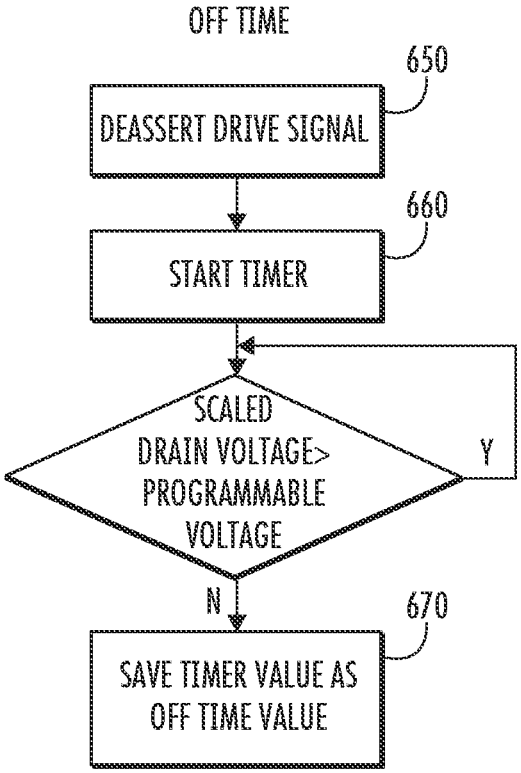

FIGS. 6A-6B show two initialization procedures that may be used to determine the ON TIME and the OFF TIME.

As shown in FIG. 6A, in one embodiment, the logic controller 220 asserts the DRIVE signal, as shown in Box 600. The assertion of the DRIVE signal may be controlled directly by the logic controller 220, or may be performed by the timer 230. The timer 230 is then started, as shown in Box 610. When the voltage of the SENSE signal exceeds the programmable voltage 210, the output from the analog comparator 200 is asserted and an interrupt may be generated. In response, the logic controller 220 may read the current value of the timer 230 and save this value in memory 240, as shown on Box 620. This value may be referred to as the ON TIME value and this process may be referred to as the ON TIME initialization procedure. This ON TIME value refers to the amount of time that the DRIVE signal should be asserted such that the SENSE signal reaches the programmable voltage 210.

In another embodiment, the transfer of the value in the timer 230 to memory 240 may be automated, such as via a direct memory access (DMA) engine in the logic controller 220 upon the assertion of the output from the analog comparator 200.

The microcontroller 100 may also include a second analog comparator 250 to compare the SCALED DRAIN signal to a second programmable voltage 260. This second programmable voltage 260 may be stored in a writable register, so that it can be modified if desired. The output of the writable register may be in communication with a Digital to Analog converter (DAC), which converts the value in the writable register to an analog voltage. This second programmable voltage 260 may be determined based on the amount of dimming that is desired. In certain embodiments, the output from the second analog comparator 250 may be used as an interrupt signal to the logic controller 220.

In certain embodiments, the second analog comparator 250 may be the same physical component as the analog comparator 200, just configured with different inputs.

For example, as shown in FIG. 6B, in one embodiment, the DRIVE signal is deasserted, as shown in Box 650. The timer 230 is then started, as shown in Box 660. When the voltage of the SCALED DRAIN signal drops below the second programmable voltage 260, the output from the second analog comparator 250 is asserted and an interrupt may be generated. In response, the logic controller 220 may read the current value of the timer 230 and save this value in memory 240, as shown in Box 670. This value may be referred to as the OFF TIME value and this process may be referred to as the OFF TIME initialization procedure.

In another embodiment, the transfer of the value in the timer 230 to memory 240 may be automated, such as via a direct memory access (DMA) engine in the logic controller 220 upon the assertion of the output from the second analog comparator 250.

In another embodiment, the microcontroller 100 may include one or more analog to digital converters (ADC). In this embodiment, the logic controller 220 may sample the ADC to monitor the increase in the SENSE signal or the decline in the SCALED DRAIN signal. As described above, the logic controller 220 may use the timer 230 to capture the ON TIME value and the OFF TIME value. Note that this embodiment also utilizes the initialization procedures shown in FIGS. 6A and 6B.

In another embodiment, the timer is not reset after the first initialization procedure. In this embodiment, the timer value at the end of the second initialization procedure is the period of the DRIVE signal. The OFF TIME value may be calculated by subtracting the ON TIME value from the period. In this embodiment, Box 660 may be omitted and Box 670 is used to save the period of the DRIVE signal to memory 240.

The ON TIME value and OFF TIME value can be used in a plurality of ways. In one embodiment, these two values are loaded into one or more timers, which are used to control the DRIVE signal. The ON TIME value is used to determine the assertion time for the DRIVE signal, while the OFF TIME value is used to determine the deassertion time for the DRIVE signal.

In another embodiment, the ON TIME value and OFF TIME value are added together to calculate the period of the DRIVE signal waveform. Alternatively, as described above, the period may be determined directly by the second initialization procedure.

The timer 230 may then be loaded with this sum, such that the timer 230 resets when this value is reached. The timer 230 may also include a comparator, such that the DRIVE signal is asserted as long as the counter value is less than the ON TIME value. Thus, in this embodiment, the ON TIME value and the OFF TIME value are used to calculate the frequency (or period) and the duty cycle of the DRIVE signal.

Once the initialization procedures are complete, the microcontroller 100 no longer needs to monitor the SENSE or SCALED DRAIN signals. Rather, the microcontroller 100 simply relies on the timer values that were calculated earlier. This may lower power consumption, as the analog comparators 200, 250 and optionally the logic controller 220 may be placed in a low power state after the initialization processes have been completed.

Thus, in this embodiment, unlike traditional LED driver ICs, the microcontroller 100 does not continuously monitor the SENSE signal in order to control the external FET 110.

This initialization procedure may also be performed whenever the desired level of dimming is altered.

In certain embodiments, this initialization procedure may be performed periodically to account for variations in the high voltage signal, for example.

In certain embodiments, the microcontroller 100 may perform one or both of the initialization procedures at predetermined times. For example, the microcontroller 100 may monitor the SCALED HV signal and perform one or both initialization procedures when the SCALED HV signal is at or near its maximum value. Specifically, the HV signal waveform may be a fully rectified sine wave, where a capacitor is used to maintain voltage during the low portions of the sine wave. Thus, the voltage of the HV signal may vary by more than 50V between its peak value and its minimum value. This change in voltage may affect the time durations that are determined by the two initialization procedures. For example, if the initialization procedure to determine the ON TIME value is performed when the HV signal is at its minimum voltage, the ON TIME value may be larger than if the initialization procedure is performed when the HV signal is at its maximum.

In other embodiments, one or both of the initialization procedures may be performed when the HV signal is at or near its minimum value. In yet another embodiment, one or both of the initialization procedures may be performed at or near both the maximum and minimum HV values and the results may be averaged.

Thus, prior to performing the processes shown in FIGS. 6A-6B, the microcontroller 100 may monitor the SCALED HV signal, such as through the use of analog to digital converter (ADC) 270 (see FIG. 5). To detect the maximum value, the microcontroller 100 may monitor the output of the ADC 270 until the values output from the ADC 270 begin to decrease. Conversely, to detect the minimum value, the microcontroller 100 may monitor the output of the ADC 270 until the values output from the ADC 270 begin to increase. Once the microcontroller 100 detects the desired change, it may begin one or both of the initialization procedures described in FIGS. 6A-6B.

While the above description describes the use of timers to control the external FET 110 following the completion of the initialization procedures, other embodiments are also possible.

For example, in one embodiment, the ON TIME initialization procedure is performed as described above. However, rather than utilizing a timer to determine the OFF TIME, the microcontroller 100 may utilize the value of the SCALED DRAIN signal. In other words, the external FET 110 may be turned on for a predetermined time, as determined by the ON TIME initialization procedure. Once the external FET 110 is turned off, the microcontroller 100 may then compare the SCALED DRAIN signal to a predetermined value (such as is done in the OFF TIME initialization procedure). Once the SCALED DRAIN signal drops to the predetermined value, the external FET 110 is turned on and the ON TIME value is loaded into the timer 230. In certain embodiments, the output of second analog comparator 250 may directly cause the assertion of the DRIVE signal and the start of the timer 230.

In another embodiment, the OFF TIME initialization procedure is performed as described above. However, rather than utilize a timer to determine the ON TIME, the microcontroller 100 may utilize the value of the SENSE signal. In other words, the external FET 110 may be turned off for a predetermined time, as determined by the OFF TIME initialization procedure. Once the external FET 110 is turned on, the microcontroller 100 may then compare the SENSE signal to a predetermined value (such as is done in the ON TIME initialization procedure). Once the SENSE signal increases to the predetermined value, the external FET 110 is turned off and the OFF TIME value is loaded into the timer 230. In certain embodiments, the output of analog comparator 200 may directly cause the deassertion of the DRIVE signal and the start of the timer 230.

In yet another embodiment, the microcontroller 100 does not perform the initialization procedures described above. Rather, the microcontroller 100 may monitor both the SENSE signal and the SCALED DRAIN signal and assert and deassert the DRIVE signal based on the voltage on each of these signals. The voltage at which the analog comparator 200 and the second analog comparator 250 are triggered may be a function of the desired level of dimming.

In certain embodiments, the voltage to be applied to the gate of the external transistor 110 may be less than or equal to the supply voltage of the microcontroller 100. In this embodiment, the DRIVE signal from the microcontroller 100 is directly connected to the gate of the external transistor 110. In other embodiments, the voltage to be applied to the gate of the external transistor 110 may be greater than the supply voltage of the microcontroller 100.

In certain embodiments, the microcontroller 100 may include a voltage boost circuit such that the DRIVE signal from the microcontroller 100 attains the voltages needed by the gate of the external transistor 110. In other embodiments, an external circuit, such as an operational amplifier (op amp) is used to multiply the DRIVE signal by a gain factor to achieve the desired gate voltage. In yet other embodiments, the DRAIN signal may be an open drain signal, where an external resistor is connected to the DRIVE signal and a higher voltage.

Thus, the DRIVE signal from the microcontroller 100 either directly connects to the gate of the external transistor 110 or is the input to a circuit that modifies the DRAIN signal so that it has the desired voltage range prior to connecting to the gate. In all embodiments, the DRIVE signal is used to control the gate of the external transistor 110, either directly or indirectly.

In addition, the microcontroller 100 may include a network interface 280, which may be in communication with the logic controller 220. The network interface 280 may support any network protocol, such as a wireless network protocol which utilizes the antenna 281. The wireless network protocol may be Bluetooth®, Zigbee® Z-Wave, or any other suitable protocol. In certain embodiments, the microcontroller 100 may receive commands via the network interface 280. These commands may instruct the microcontroller 100 to turn off the LED array 20, turn on the LED array 20, or change the level of dimming. In response to a command to change the level of dimming, the microcontroller 100 may, for example, change the value of the programmable voltage 210, the second programmable voltage 260, and then execute the initialization procedures described above. Further, in certain embodiments, the microcontroller 100 may execute the initialization procedures when a command to turn on the LED array is received. Additionally, the microcontroller 100 may also receive firmware updates via the network interface 280, thereby allowing the functionality of the LED array control circuit to be modified after manufacturing.

The present system and method have many advantages. First, by including the functionality of a LED Driver IC into the microcontroller 100, the cost of the overall circuit may be reduced. Second, by incorporating the LED driver controller into a microcontroller 100, it is possible to perform device calibrations. Finally, the use of a microcontroller 100 allows changes or updates to the circuit after it has already shipped to a customer, via firmware updates transmitted via the network interface 280. In contrast, any modifications to a LED driver IC must be made via hardware changes. For example, additional features may be added to the circuit at a later date if desired.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A circuit for driving an LED array comprising:

the LED array in communication with a high voltage (HV) signal;

an inductor in series with the LED array;

a sense resistor connected to ground;

an external transistor comprising a drain, a source and a gate, wherein the drain is in communication with the inductor and the source is in communication with the sense resistor, such that when the external transistor is enabled, current flows from the HV signal through the LED array, the inductor, the external transistor and the sense resistor;

a diode disposed between the drain and the HV signal; and a microcontroller, comprising:

an output signal, referred to as a DRIVE signal, that controls the gate of the external transistor;

a first analog input in communication with the source of the external transistor, referred to as a SENSE signal; and a second analog input in communication with a signal representative of a voltage at the drain of the external transistor, referred to as a SCALED DRAIN signal;

wherein, during a first initialization procedure, the microcontroller determines an amount of time, after the external transistor is enabled, for the SENSE signal to reach a predetermined voltage, referred to as an ON TIME value, and wherein during normal operation, the microcontroller uses the ON TIME value to control the DRIVE signal.

2. The circuit of claim 1, wherein the microcontroller comprises a timer and an analog comparator, wherein the analog comparator compares the SENSE signal to the predetermined voltage, and generates an output when the SENSE signal is greater than the predetermined voltage, and wherein a value of the timer is saved as the ON TIME value when the output of the analog comparator is asserted.

3. The circuit of claim 1, wherein a value indicative of the predetermined voltage is stored in a writable register and is related to a level of dimming desired.

4. The circuit of claim 1, wherein during a second initialization procedure, the microcontroller determines an amount of time, after the external transistor is disabled, for the SCALED DRAIN signal to drop to a second predetermined voltage, referred to as an OFF TIME value, and wherein during normal operation, the microcontroller uses the OFF TIME value to control the DRIVE signal.

5. The circuit of claim 4, wherein a value indicative of the second predetermined voltage is stored in a writable register and is related to a level of dimming desired.

6. The circuit of claim 4, wherein the microcontroller comprises a timer and a second analog comparator, wherein the second analog comparator compares the SCALED DRAIN signal to the second predetermined voltage, and generates an output when the SCALED DRAIN signal is less than the second predetermined voltage, and wherein a value of the timer is saved as the OFF TIME value when the output of the second analog comparator is asserted.

7. The circuit of claim 4, wherein the microcontroller adds the ON TIME value and the OFF TIME value to calculate a period of the DRIVE signal.

8. The circuit of claim 4, wherein a timer internal to the microcontroller is used to control the DRIVE signal based on the ON TIME value and the OFF TIME value.

9. The circuit of claim 1, comprising a scaling circuit in communication with the drain of the external transistor to generate a scaled version of the voltage at the drain, referred to as the SCALED DRAIN signal.

10. The circuit of claim 1, wherein the microcontroller comprises a third analog input representative of the HV signal, referred to as a SCALED HV signal.

11. The circuit of claim 10, further comprising a second scaling circuit in communication with the HV signal to generate the SCALED HV signal.

12. The circuit of claim 10, wherein the microcontroller monitors the SCALED HV signal before performing the first initialization procedure.

13. The circuit of claim 12, wherein the controller waits for the SCALED HV signal to reach a maximum value before performing the first initialization procedure.

14. The circuit of claim 1, wherein the DRIVE signal is directly connected to the gate of the external transistor.

15. A circuit for driving an LED array comprising:

the LED array in communication with a high voltage (HV) signal;

an inductor in series with the LED array;

a sense resistor connected to ground;

an external transistor comprising a drain, a source and a gate, wherein the drain is in communication with the inductor and the source is in communication with the sense resistor, such that when the external transistor is enabled, current flows from the HV signal through the LED array, the inductor, the external transistor and the sense resistor;

a diode disposed between the drain and the HV signal; and a microcontroller, comprising:

an output signal, referred to as a DRIVE signal, that controls the gate of the external transistor; and a first analog input in communication with the source of the external transistor, referred to as a SENSE signal;

a second analog input in communication with a signal representative of a voltage at the drain of the external transistor, referred to as a SCALED DRAIN signal;

wherein, after performing a first initialization procedure, the microcontroller controls the DRIVE signal without monitoring the SENSE signal; and wherein, during a second initialization procedure, the microcontroller determines an amount of time, after the external transistor is disabled, for the SCALED DRAIN signal to drop to a second predetermined voltage, referred to as an OFF TIME value, and wherein during normal operation, the microcontroller uses the OFF TIME value to control the DRIVE signal without monitoring the SCALED DRAIN signal.

16. A microcontroller for controlling an LED array, comprising:

an output signal, referred to as a DRIVE signal, configured to control a gate of an external transistor;

a first analog input in communication with a source of the external transistor, referred to as a SENSE signal; and a second analog input in communication with a signal representative of a voltage at a drain of the external transistor, referred to as a SCALED DRAIN signal;

a timer; a writable register; and an analog comparator;

wherein, during a first initialization procedure, the analog comparator compares the SENSE signal to a predetermined voltage, wherein a value indicative of the predetermined voltage is stored in the writable register; and wherein an amount of time, referred to as an ON TIME value, after the DRIVE signal is asserted for the SENSE signal to reach the predetermined voltage is saved as the ON TIME value when an output of the analog comparator is asserted;

and wherein during normal operation, the microcontroller uses the ON TIME value to control the DRIVE signal.

17. The microcontroller of claim 16, further comprising a second analog comparator and a second writable register, wherein the second analog comparator compares the SCALED DRAIN signal to a second predetermined voltage, wherein a value indicative of the second predetermined voltage is stored in the second writable register; and wherein an amount of time, referred to as an OFF TIME value, after the DRIVE signal is deasserted, for the SCALED DRAIN signal to drop to the second predetermined voltage is saved as the OFF TIME value when the output of the second analog comparator is asserted; and wherein during normal operation, the microcontroller uses the ON TIME value and the OFF TIME value to control the DRIVE signal.

18. The microcontroller of claim 16, further comprising a second analog comparator and a second writable register, wherein the second analog comparator compares the SCALED DRAIN signal to a second predetermined voltage, wherein a value indicative of the second predetermined voltage is stored in the second writable register; and wherein a total amount of time, after the DRIVE signal was asserted until the SCALED DRAIN signal drops to the second predetermined voltage is saved as a period, when the output of the second analog comparator is asserted and wherein during normal operation, the microcontroller uses the ON TIME value and the period to control the DRIVE signal.

* * * * *